US005924153A

United States Patent [19]

Salley

[11] Patent Number: 5,924,153

[45] Date of Patent: Jul. 20, 1999

[54] DUST REMOVAL DEVICE

[76] Inventor: Sharon Salley, P.O. Box 196, Lake Havasu City, Ariz. 86405-0196

[21] Appl. No.: 08/965,106

[22] Filed: Nov. 6, 1997

Related U.S. Application Data

[60] Provisional application No. 60/030,001, Nov. 7, 1996.

[51] Int. Cl.[6] ..... A47L 13/40

[52] U.S. Cl. ..... 15/1.52; 15/210.1; 15/226

[58] Field of Search ..... 15/1.51, 1.52, 15/160, 207.2, 208, 209.1, 210.1, 226, 228, 229.1, 229.2, 229.3, 229.4, 229.7, 229.8, 235

[56] References Cited

U.S. PATENT DOCUMENTS

| | | | |
|---|---|---|---|
| 119,890 | 10/1871 | Smith | 15/211 |
| D. 226,886 | 5/1973 | Codina | D4/137 |
| D. 249,821 | 10/1978 | Cooke et al. | D4/199 |
| D. 260,188 | 8/1981 | Boykin, Jr. | D28/10 |
| 346,773 | 8/1886 | Rees | 401/200 |
| D. 354,595 | 1/1995 | Wasak | D32/52 |
| 534,839 | 2/1895 | Nelsen | 15/235 |
| 885,276 | 4/1908 | McDonald | 15/209.1 |
| 1,079,672 | 11/1913 | Simpson | 15/209.1 |
| 1,434,183 | 10/1922 | Abrahams | 15/209.1 |
| 1,639,718 | 8/1927 | Bacorn | 15/210.1 |
| 1,928,111 | 7/1933 | Mednick | 401/47 |
| 2,156,270 | 5/1939 | Smith | 15/209.1 |
| 2,526,468 | 10/1950 | Frye | 15/210.1 |
| 2,704,375 | 3/1955 | Haeusser | 15/109.94 |
| 2,877,482 | 3/1959 | Roy | 15/220.3 |
| 2,948,003 | 8/1960 | Tamsberg | 15/1.51 |
| 3,067,449 | 12/1962 | Weissenbach | 401/18 |
| 4,254,530 | 3/1981 | Lambert | 15/235 |
| 4,305,173 | 12/1981 | Isao | 15/1.52 |
| 4,373,224 | 2/1983 | Bandai et al. | 15/1.52 |
| 4,656,686 | 4/1987 | Moss et al. | 15/229.8 X |

FOREIGN PATENT DOCUMENTS

| | | | |
|---|---|---|---|
| 620820 | 5/1961 | Canada | 15/1.52 |
| 57-101073 | 6/1982 | Japan | 15/228 |
| 4-189338 | 7/1992 | Japan | 15/235 |
| 670504 | 12/1968 | Netherlands | 15/210.1 |
| 194150 | 2/1938 | Switzerland | 15/1.52 |

*Primary Examiner*—Mark Spisich

*Attorney, Agent, or Firm*—Knobbe, Martens, Olson & Bear, LLP

[57] ABSTRACT

An apparatus for cleaning electrostatically charged dust particles from a CRT screen. The apparatus includes a base member having a handle. An artificial fleece material is attached to the base member so as to cover an entire surface of the base member. The artificial fleece material has a plurality of fibers that extend generally outward from the base member. Mechanical movement of the artificial fleece over the surface of the CRT results in mechanical dislodgement of the dust particles. Further, the mechanical movement also results in an electrostatic charge developing on some of the polymer fibers. The electrostatically charged fibers can then attract electrostatically charged dust particles preventing these particles from re-adhering to the CRT screen.

4 Claims, 2 Drawing Sheets

DUST REMOVAL DEVICE

This application claims the benefit of U.S. provisional application No. 60/030,001, filed Nov. 7, 1996.

BACKGROUND OF THE INVENTION

1. Field of the Invention

The present invention generally relates to cleaning tools and devices and, more particularly, to tools used for cleaning CRT (Cathode Ray Tube) screens such as computer monitor screens and TV screens.

2. Description of the Related Art

Dust on our TV or computer monitor screens is one of the most common, yet annoying, problems that we encounter in our daily household or office environment. Even in the spaces that are regularly cleaned and kept clean, a thin dust layer quickly builds up and becomes visible to the eye when such screens are in use even for just a short while. In fact, a dust layer on these computer and TV screens seems to build up faster than a dust layer on any other object in the same environment. The answer to this puzzle is directly related to the electric field and resulting static electricity occurring on such screens which causes dust accumulation by attracting the dust over the surface of the screens.

Television or computer monitor screens are essentially made of CRTs (cathode ray tubes). CRTs, or as is often referred to CRT tubes, are basically vacuum tubes shaped to have a front screen portion, and equipped with image forming devices to form images on the screen. These image forming devices are further connected to a high voltage source. During operation, a high voltage source induces the image forming device to generate an electron beam which scans the inner side of the screen and forms an image on the screen thereby allowing a viewer to see that image. The scanning electron beam and high voltage source creates electric fields and magnetic fields on the CRT screen. In fact, these fields result in static electricity occurring on the front screen of the CRT. Static electricity on the CRT tube is basically a stray surface current on the front surface of the CRT which is often referred to as static charge.

The interaction of the static charge on the screen and the static charge associated with minute airborne dust particles results in some of these charged dust particles being attracted to and adhering to the screen. In particular, there are also some dust particles that already carry some static charge on them, such as tiny fibers of household upholstery, carpet fibers, etc. The friction that causes these particles to become detached and airborne may also cause the particles to accumulate static charge. These charge carrying particles can be attracted easily from a distance towards the screen, with the help of an electric field generated from the screen, and deposited over the screen. Even non-electrically charged dust particles can become electrically charged and attracted to a CRT screen when these dust particles float in proximity to the front screen of the CRT.

These electrically charged dust particles are very difficult to clean off of the computer screen. In particular, as the dust particles are electrically charged, using a cloth or one's hand often simply dislodges the charged particles from the screen which are subsequently re-attracted to the screen by the electrical field existing thereon. Hence, using a rag or cloth that can be positioned adjacent the screen to clean the screen is often rather ineffective in removing the dust from the screen.

A damp cloth or a cloth soaked in an anti-static solution can also be used. However, soaking the cloth prior to dusting the screen is time consuming and does not permit easy cleaning of the screen on an as-needed basis. Specifically, the user of the computer or the viewer of the television screen must obtain the cloth and the solution and then pre-soak the cloth prior to cleaning the screen. While this method is more effective than using a dry rag, it is not only time consuming and inefficient, but keeping solutions such as water or anti-static solution in proximity to the screen can result in spills that can damage the electronic equipment.

From the foregoing, it is apparent that there is a need for a tool that is capable of efficiently cleaning a screen of a computer or television set that can be safely positioned adjacent the screen and used on an as-needed basis. To this end, there is a need for a tool that is capable of removing electrically charged dust particles from the proximity of a screen to clean the screen without requiring the use of solvents or water.

SUMMARY OF THE INVENTION

The aforementioned needs are satisfied by the screen cleaning tool of the present invention which includes a screen brush to clean the screens of CRT tubes. The screen brush preferably comprises an application surface which is comprised of an artificial fleece having a plurality of relatively densely located and long polymer fibers. One end of these fibers is firmly secured against a skin portion of the fleece. The production of the screen brush is completed by adhering the skin portion of the fleece to a base-section comprising a handle to hold the brush.

During cleaning, the fleece is placed over the screen and moved to sweep and collect the dust from the screen. The movement of the fleece over the screen results in both a mechanical sweep effect to dislodge the charged dust particles and a static charge accumulation on the ends of the fibers. This static charge accumulation results from friction between the screen and the fleece, and/or a static charge transfer occurring between the screen and the fleece. Advantageously, the attractive force created by the static charge accumulation on the fibers collects the charged dust particles which are dislodged from the computer screen by the mechanical sweep. This combined action cleans the dust from the screens of CRT tubes more effectively as the charged dust particles are attracted to the fibers which results in fewer dust particles getting on the screen.

Hence, the device of the present invention is configured to reduce charge accumulation on the screen of a computer or television set and is also configured to attract and retain electrically charged particles of dust. The device is therefore more effective in cleaning dust off of CRT screens without requiring the use of solvents or water.

These and other objects and advantages of the present invention will become more fully apparent from the following description taken in conjunction with the accompanying drawings.

DETAILED DESCRIPTION OF THE PREFERRED EMBODIMENT

Figure 1:
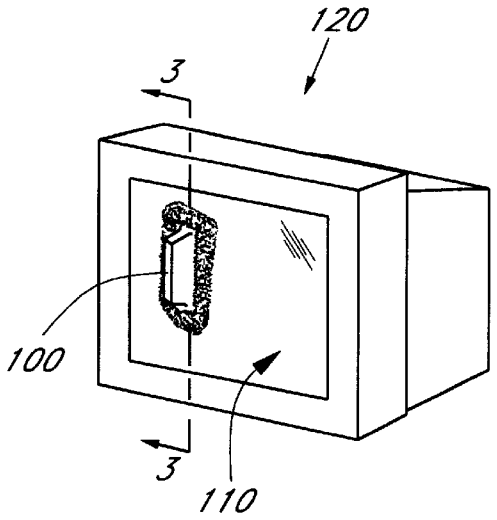
FIG. 1 is a schematic representation showing a possible way for applying the dust removal device over a screen of a computer monitor to remove the dust.

Reference will now be made to the drawings wherein like numerals refer to like parts throughout. FIG. 1 illustrates a dust removal device 100 as it is applied over a screen 110 of a monitor 120 to dissipate and remove a layer of dust positioned over the screen 110.

Figure 2:
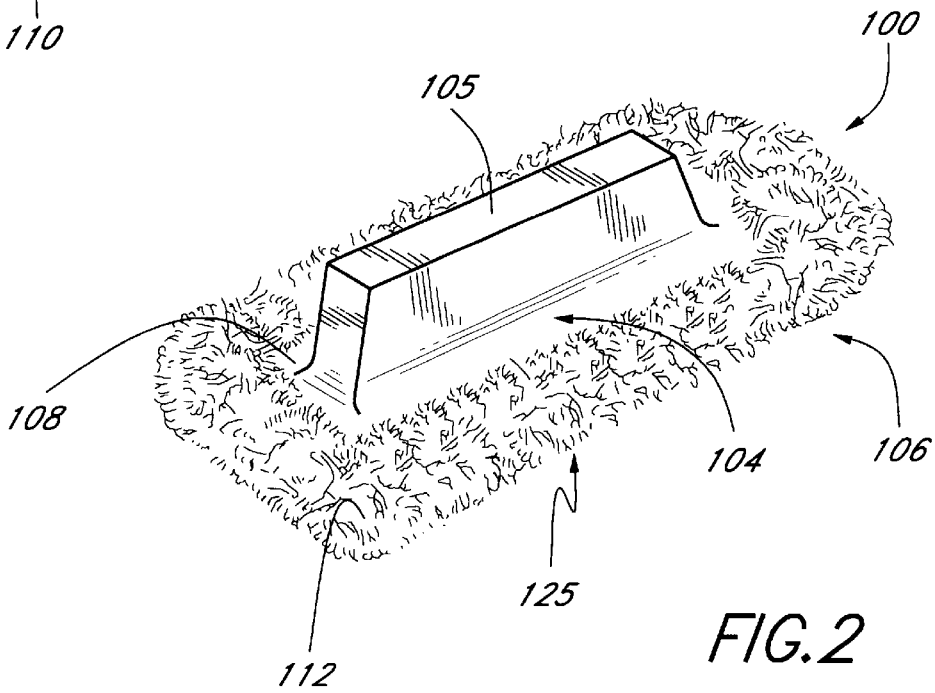
FIG. 2 is a perspective representation of the dust removal device shown in FIG. 1.

FIG. 2 illustrates the components of the dust removal device 100 of the preferred embodiment in greater detail. The dust removal device 100 is comprised of a base-section 104 and a brush-end section 106. The base-section 104 further comprises a raised handle portion 105 which is perpendicular to a base-board 108 and is configured to allow a user to hold the dust removal device 100 during the screen cleaning. The base-section 104 can be made of wood or plastic, or another material well-known in the art.

Figure 3:
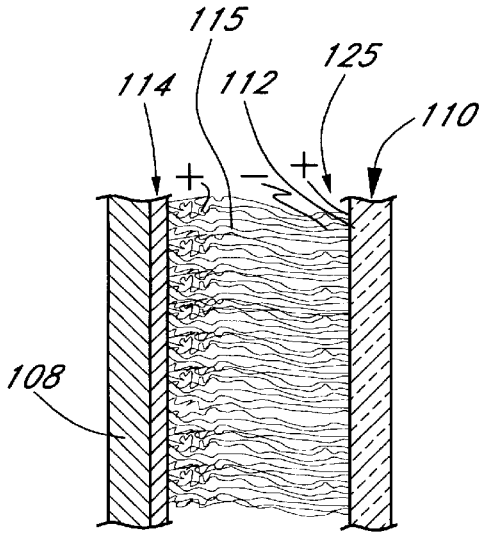
FIG. 3 is a schematic section of the dust removal device shown in FIG. 1 wherein the fibers of the dust removal device are in contact with the surface of the screen.

Referring now to FIGS. 2 and 3, the brush end 106 of the dust removal device 100 is comprised of an artificial fleece material 112 which, in the preferred embodiment, is known as Sherpa material. This artificial fleece 112 is comprised of numerous long and densely positioned polymer fibers 113 of which one end of these fibers 113 is firmly secured to a skin portion 114 of the fleece 112. The free ends 115 of the individual fibers 113 form an application surface 125 for the dust removal device 100 as the fibers 113 are densely distributed across the entire brush-end 106. The skin portion 114 of the artificial fleece 112 is attached over the base-board 108 as shown in FIG. 2, as a result of being sewn and sized to slip over the baseboard and be securely retained thereon. This permits removal of the material 112 for cleaning of the pad if necessary. As shown in FIG. 2, the artificial fleece 112 is preferably curved upwards at the edges so as to extend outward from the base surface 108. This results in the rigid base 108 always being covered by the fleece 112 so that the edges of the base surface 108 are prevented from scratching the computer or TV screen.

Referring to FIG. 1, during the cleaning of the screen 110 the dust removal device 100 is positioned over the screen 110 so that the application surface 125 comes into contact with the surface of the screen 110 and is moved in a circular or transversal motion to sweep and collect the dust from the screen 110. As is previously explained, however, the dust particles over the screen 110 of the CRT tube are often electrically charged and are electrically attracted to the computer screen. The long fibers 113 of the fleece 112, however, become electrically charged by the movement over the screen 110 thereby dissipating the static charge on the screen 110 and attracting the charged dust particles.

More particularly, as is shown in detail in FIG. 3, if the application surface 125 of the dust removal device 100 is placed over the screen 110 to start the cleaning action, the densely positioned fiber ends 115 come into contact with the screen 110. It will be understood that if a static electricity source is contacted with another material, static electricity generally tends to flow towards this contacting material. Therefore, this contact between the screen 110 and the ends 115 of the fleece fibers 113 may convey the static electricity from the screen 110 to the fleece 112 through the surface of the fibers 113.

Moreover, during the cleaning action, these fiber ends 115, as well as the fibers 113 themselves slide against the screen 110 and against each other which causes friction on the fibers 113. These frictional forces result in charge carriers adhering to the fibers 113 and thereby electrostatically charging the fibers.

Figure 4:
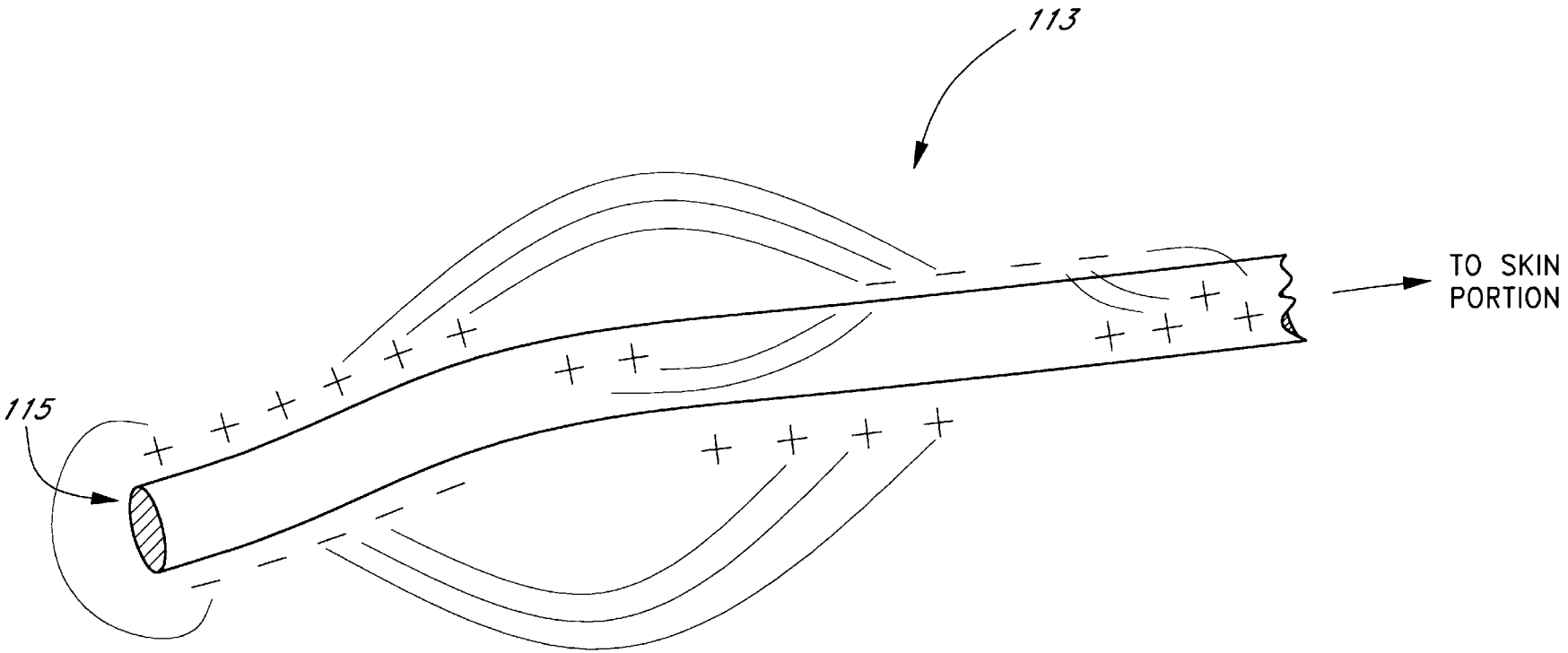
FIG. 4 is a magnified view of a representative fiber of the dust removal device shown in FIG. 3.

This situation is schematically shown in FIG. 4. FIG. 4 shows a single fiber body 113 with accumulated negative (−) and positive (+) charges positioned over the fiber 113. These accumulated charges result in the creation of electrical fields that are represented by curved lines in FIG. 4. Consequently, the static charge accumulation on the fibers 113 and the resulting electrical field can be created by both the frictional forces exerted on the fibers and the direct transfer of static charge from the screen 110 to the fibers 113 when the fibers 113 come in contact with the screen 110. The attractive force created by this static charge accumulation attracts the charged dust particles into the fleece 112 and holds the particles in the fleece 112. It would be appreciated that during the cleaning process charged dust particles are mechanically dislodged from the screen and the charged dust particles are then attracted by the charge on the fibers 113. Hence, the dust removal device 100 both removes dust and charge from the screen 110 in an efficient manner.

It would be appreciated that, as opposed to prior art, the present invention provides a reliable, easy to manufacture and convenient tool to clean monitors or TV screens. During the cleaning, a combination of mechanical sweep and the electrostatic field created by the dust removal device removes charged dust particles from the screen while reducing the need for the use of water or anti-static solvents. Hence, the dust removal device can be positioned adjacent the monitor or screen and used on an as-needed basis to remove dust from the screen without requiring the time consuming application of solvents or the like.

Although the foregoing description of the preferred embodiment of the present invention has shown, described and pointed out the fundamental novel features of the invention, it will be appreciated by those skilled in the art that various omissions, substitutions and changes in the form of the detail of the apparatus as illustrated, as well as the uses thereof, may be made by those skilled in the art without departing from the scope and spirit of the present invention.

What is claimed is:

1. An apparatus for removing electrostatically charged dust particles from a display of a CRT-tube, the apparatus comprising:

(A) a substantially planar and generally rectangular base member having opposed first and second sides, the base member further having a plurality of vertical sides about the periphery thereof;

(B) a handle positioned on and substantially perpendicular to the first side of the base member;

(C) a brush member attached to the second side of the base member wherein the brush member comprises an artificial fleece material, the artificial fleece material comprising a skin section and a fiber section covering one side of the skin section, the fiber section comprising a plurality of polymer fibers extending outward from the one side of the skin section, the skin section as well as the covering section of polymer fibers covering the second side of the base member and also the vertical sides thereof; and (D) wherein movement of the artificial fleece material over the CRT-tube results in dust on the CRT tube being mechanically dislodged from the surface of the CRT tube and also results in at least some of the plurality of polymer fibers being electrostatically charged so as to be able to attract electrostatically charged dust particles.

2. The apparatus of claim 1, wherein the artificial fleece material is comprised of Sherpa material.

3. The apparatus of claim 1, wherein the artificial fleece material is formed so as to define an opening that is positioned around the rectangular base member so as to retain the artificial fleece material on the base member in a manner that permits selective removal of the artificial fleece material from the base member.

4. The apparatus of claim 3, wherein the base member has vertical sides surrounding the rectangular surface and wherein the artificial fleece material is further formed so as to cover the vertical sides of the base member so as to be interposed between the base member and the surface of the CRT screen during cleaning of the CRT screen.

* * * * *